United States Patent [19]

Morimoto et al.

[11] Patent Number: 4,542,317

[45] Date of Patent: Sep. 17, 1985

[54] FLUORESCENT DISPLAY TUBE

[75] Inventors: Kiyoshi Morimoto; Hiroshi Watanabe, both of Mobara, Japan

[73] Assignee: Futaba Denshi Kogyo K.K., Mobara, Japan

[21] Appl. No.: 450,667

[22] Filed: Dec. 17, 1982

[30] Foreign Application Priority Data

Dec. 19, 1981 [JP] Japan ..... 56-205556

[51] Int. Cl.[4] ..... H05B 33/06; H05B 33/12

[52] U.S. Cl. ..... 313/496; 313/513

[58] Field of Search ..... 313/496, 497, 516, 517, 313/510, 513, 519

[56] References Cited

U.S. PATENT DOCUMENTS

| | | | |
|---|---|---|---|
| 3,500,392 | 3/1970 | Waljuk et al. | 313/517 |
| 3,723,789 | 3/1973 | Tanji | 313/497 |
| 4,455,774 | 6/1984 | Watanabe | 313/496 X |

*Primary Examiner*—Palmer Demeo
*Assistant Examiner*—Sandra L. O'Shea
*Attorney, Agent, or Firm*—Oblon, Fisher, Spivak, McClelland & Maier

[57] ABSTRACT

A fluorescent display tube of the type that luminous display is observed through a substrate is disclosed which is capable of accomplishing luminous display easily observable in a light environment as well and without any display defect, providing luminous display with a wide visual angle and simplifying the manufacturing process. The fluorescent display tube includes a substrate made of a light-permeable and light-scattering insulating material and a metal film deposited on the substrate which has a color similar to non-luminous color of anodes and also acts as feeder paths. The metal film is formed with openings corresponding to the shape of a display pattern in which transparent anode conductors each having a fluorescent layer deposited thereon are received.

8 Claims, 11 Drawing Figures

FLUORESCENT DISPLAY TUBE

BACKGROUND OF THE INVENTION

1. Field of the Invention

This invention relates to a fluorescent display tube, and more particularly to a fluorescent display tube of the type that luminous display is observed through a substrate which can carry out luminous display easily observable and without any display defect and simplify the manufacturing process.

2. Description of the Prior Art

A conventional fluorescent display tube is generally constructed in a manner such that luminous display in the form of a letter, a figure or the like obtained by impinging electrons emitted from a heated cathode on an anode having a fluorescent layer deposited thereon is observed through the cathode. However, the fluorescent display tube of such type has a disadvantage that it is difficult to provide luminous display with a good visibility and a wide visual angle.

In order to eliminate such disadvantage, a fluorescent display tube of the type that luminous display is observed through a substrate has been recently proposed. In a fluorescent display tube of this type, a substrate on which anode sections are to be formed is made of a light permeable material such as glass or the like and an anode is formed of a transparent conductive material such as $SnO_2$, $In_2O_3$—$SnO_2$ composite referred to as "ITO" so that luminous display may be observed through the anode and substrate.

A conventional fluorescent display tube of such type will be hereinafter described in detail with reference to FIG. 1.

A fluorescent display tube shown in FIG. 1 includes a substrate 1 made of a light permeable insulating material such as a sheet glass, on which wiring conductors 2 and anode conductors 4 each formed of a transparent conductive material are deposited. The substrate 1 also has insulating layers 3 of a light impermeable property applied thereon except the portions thereof corresponding to display pattern sections. Each of the anode conductors 4 has a fluorescent layer 5 deposited on the exposed surface thereof which is not covered by the insulating layer 3, to thereby form an anode 6. Above the anodes 6, filamentary cathodes 7 are stretched so as to oppose to the corresponding anodes. The fluorescent display tube also includes a mesh-like control electrode 8 disposed between the anodes 6 and the cathodes 7. These electrode elements are received in an envelope which is formed by hermetically sealing a casing 9 on the periphery of the substrate 1 and is highly evacuated. The wiring conductors 2 are led out from the casing 9 to be connected to corresponding external terminals 10.

The fluorescent display tube of FIG. 1 adapted to observe luminous display of the anodes 6 through the substrate 1 has an advantage of accomplishing luminous display easily observable because a wide visual angle is obtained and the internal structure is out of sight by the substrate.

Recently, a fluorescent display tube has been extensively used in various environments with the extension of use. For example, a fluorescent display tube incorporated in display systems for vehicles is used in a light environment as well. However, the conventional fluorescent display tube of the type that display is observed through a substrate as mentioned above is not suitable for use in such environment because it cannot form a distinct contrast between light emitting anodes and non-light emitting anodes. In addition, in the conventional fluorescent display tube of this type, the wiring conductors are formed of metal oxide. However, metal oxide is not optimum as a material for the wiring conductor, because the wiring conductor formed of this material is apt to increase in resistance.

BRIEF SUMMARY OF THE INVENTION

The present invention has been made in view of the foregoing disadvantages of the prior art while taking notice of the fact that a metal film such as, Al, Ag, Cu, Cr or the like deposited on one surface of a light scattering substrate such as a ground glass plate, when being viewed through the other surface of the substrate, is observed to present a faded color such as turbid or opaque white or white-yellow color by losing its metallic sheen.

Accordingly, it is an object of the present invention to provide a fluorescent display tube of the type that luminous display is observed through a substrate which is capable of effecting luminous display easily observable in a light environment as well and without any display defect.

It is another object of the present invention to provide a fluorescent display tube capable of providing luminous display with a wide visual angle.

It is another object of the present invention to provide a fluorescent display tube capable of substantially simplifying the manufacturing process.

It is a further object of the present invention to provide a fluorescent display tube having high structural strength and performance.

It is still a further object of the present invention to provide a fluorescent display tube capable of completely preventing a display defect.

In accordance with the present invention, there is provided a fluorescent display tube comprising: a substrate made of a light permeable insulating material; a metal film depositedly formed on one surface of the substrate, the metal film being formed with openings corresponding to the shape of a display pattern; anode conductors formed of a substantially transparent conductive material, each of the anode conductors being depositedly formed in each of the openings so as to cover the portion of the substrate at which the opening is provided and at least a part of the metal film provided at the periphery of the opening; a fluorescent layer deposited on each of the anode conductors which emits light when electrons from a cathode impinge thereon; whereby luminous display display of the fluorescent layers is adapted to be observed through the other surface of the substrate. The substrate preferably has a light scattering property as well as a light permeable property.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Now, a fluorescent display tube according to the present invention will be hereinafter described with reference to the accompanying drawings.

Figure 1:
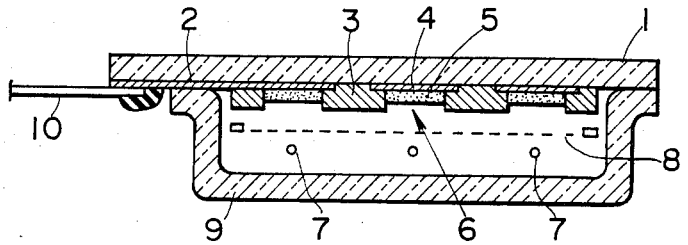
FIG.1 PRIOR ART
FIG. 1 is a vertical sectional view showing the essential portion of a conventional fluorescent display tube of the type that luminous display is observed through a substrate.
Figure 2:
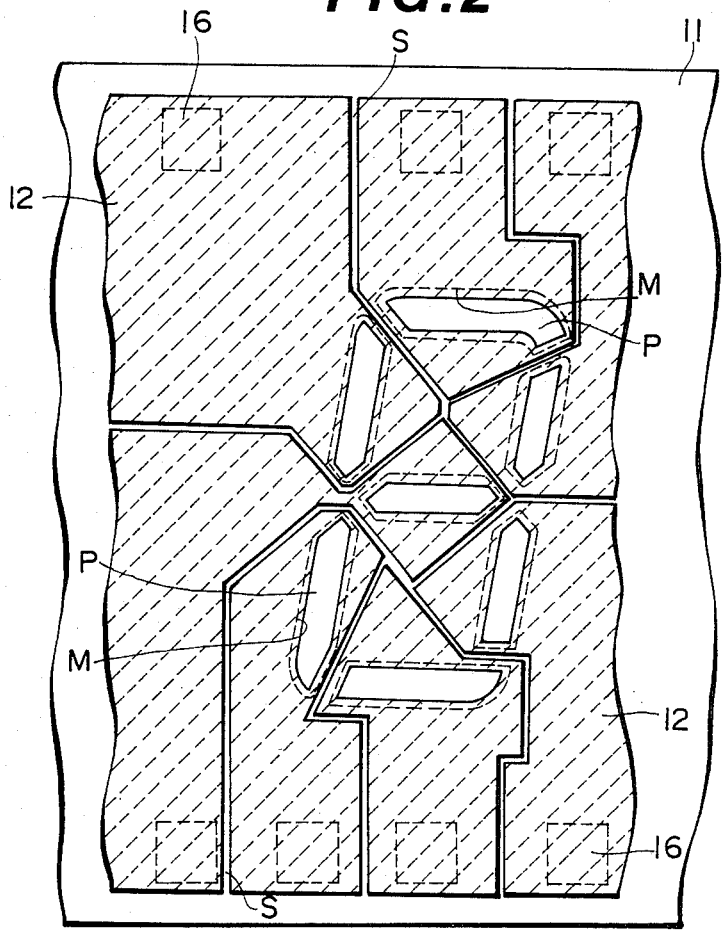
FIG. 2 is a plan view illustrating the essential portion of one embodiment of a fluorescent display tube according to the present invention.
Figure 3:
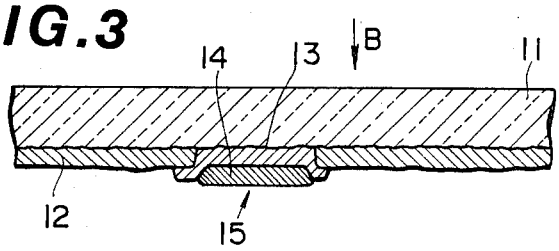
FIG. 3 is an enlarged partial sectional view of the fluorescent display tube shown in FIG. 2.

FIGS. 2 and 3 are a plan view and a sectional view showing the essential portion of one embodiment of a fluorescent display tube according to the present invention, respectively. The fluorescent display tube includes a substrate 11 formed of an insulating material which has transparent and light scattering properties. For example, the substrate 11 may be formed of a frosted glass such as ground glass, etched glass, opaline glass or the like.

More particularly, the substrate 11 may be formed by subjecting a transparent glass plate to a physical surface treatment such as sandblasting or the like or a chemical surface treatment such as etching utilizing a corrosive liquid such as a hydrogen fluoride solution or the like to form the surface of the glass plate with fine roughness, to thereby form the glass plate with a frosted surface.

Alternatively, the substrate 11 may be made by baking fine glass powder on the surface of a glass plate to form the glass plate with a satin-like surface, to thereby provide the glass plate with a light scattering property.

Otherwise, the substrate 11 may be made of an opaline glass plate formed by providing a thin layer of translucently colored glass on the surface of a transparent glass plate to provide the glass plate with a light scattering property.

The substrate 11 is depositedly formed on one surface thereof with a metal film 12, which is patterned in a predetermined shape. In the embodiment illustrated, a ground glass plate is used as the substrate 11 and the metal film 12 is deposited on the rough surface of the ground glass plate. The metal film may be formed by vacuum vaporization, sputtering, ion plating or the like.

The metal film 12 is preferably formed of a metal presenting color similar to non-luminous color of a fluorescent layer detailedly described hereinafter, when luminous display is observed from the other side of the substrate 11 on which the metal film 12 is not deposited. For example, when a ZnO fluorescent layer is deposited of which non-luminous color is white or translucent-white, the metal film is preferably formed of Al, Ag, Cr or the like. Whereas, when a fluorescent layer of yellow-white in non-luminous color is deposited, Au, Cu or the like is preferably used as a material of the metal film 12.

When viewing the substrate 11 having the metal layer 12 of, for example, Al deposited on one surface thereof as shown in FIG. 3 from the direction indicated by an arrow B, the metal film 12 is observed to be white or translucent-white because the roughness formed on the surface of the substrate 11 carries out a light scattering function to decrease or extinguish gloss of the metal film 12.

The metal film 12 deposited on one surface of the substrate 11, as shown in FIG. 2, is patterned into a predetermined shape by removing the unnecessary portions of the metal film by etching to leave the portions shown in broken lines, so that slits S and openings P are formed. In the embodiment illustrated, each display pattern section is formed to carry out a display in the form of the letter "8" and is adapted to be operated by a static driving system. The patterning of the metal film as shown in FIG. 2 may be carried out utilizing a well-known photolithography procedure. More particularly, it may be accomplished in such a manner to remove the unnecessary portions of the metal film 12 by etching to form the openings at the positions corresponding to the display pattern sections and the slits S at the positions corresponding to insulating areas between wiring conductors.

In each of the openings P, an anode conductor 13 formed of a transparent conductive material such as $SnO_2$, ITO or the like is depositedly provided so as to electrically contact with the metal film 12 through at least the periphery of the opening P.

The anode conductors 13 may be formed, for example, by printing and calcining an organometallic compound paste containing In in correspondence to the shape of the display pattern sections.

Alternatively, the anode conductors 13, as shown in FIG. 2, may be formed according to a CVD procedure using masks having openings M larger in size than the openings P.

Figure 4:
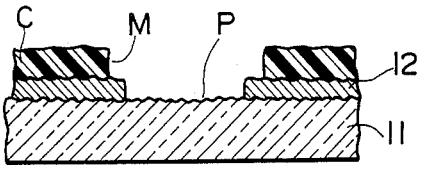
FIGS. 4 (*a*) to (*d*) are schematic sectional views showing a part of a process for manufacturing the fluorescent display device shown in FIG. 2.
Figure 4:
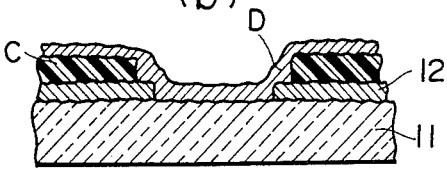
Figure 4:
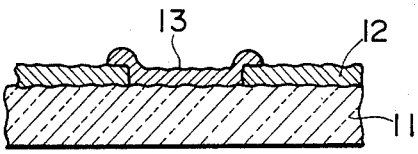
Figure 4:
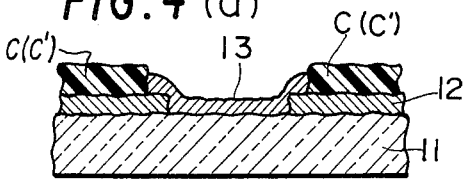

Otherwise, the anode conductors 13 may be formed in such a manner as shown in FIGS. 4 (*a*) to (*d*). More particularly, first the metal film 12 deposited on the substrate 11 and having the openings P provided therein is applied thereon a mask layer C having openings M larger in size than the openings P according to a screen printing procedure, as shown in FIG. 4 (*a*). Then, a transparent conductive material D is applied on the entire surface of the substrate on which the mask layer C is applied, as shown in FIG. 4 (*b*). Subsequently, the unnecessary portions of the conductive material D and mask layer C are removed by a suitable procedure such as, for example, blasting, etching or the like, thus, anode conductors 13 are formed as shown in FIG. 4(*c*).

In this instance, where the mask layer C is formed of a material which turns white or translucent-white when it is subjected to printing and calcining treatments, the mask layer C may be left on the metal film 12, as shown in FIG. 4(*d*). Alternatively, an insulating layer C′ is depositedly formed on the metal film 12 by printing or the like after removing the mask layer C. The so-formed mask layer C or insulating layer C′ serves to prevent the contact between the metal film 12 and control electrodes 8. In addition, the slits S are also provided with a mask layer C or an insulating layer C′ in a similar manner, this effectively preventing luminescence from leaking through the slits.

On each of the anode conductors formed as mentioned above, a fluorescent layer 14, as shown in FIG. 3, is deposited so as to cover at least the opening P and preferably the opening P and the periphery thereof to form an anode 15, so that an anode substrate is provided.

When viewing the so-formed anode substrate from the direction indicated by the arrow B shown in FIG. 3, the portions of the anode substrate having the metal film 12 and fluorescent layers 14 deposited thereon are observed to present white or translucent-white color when the fluorescent layers do not emit light. Thus, it will be noted that the portions of the metal film 12 forming a background of the display sections are observed to present the substantially same color as non-luminous color of the display pattern sections.

The anode substrate is further constructed in a manner such that the metal film 12 extends to the periphery of the substrate 11 and is divided into a plurality of sections electrically separated from one another by the slits S and electrically connected to the corresponding anodes 15. Thus, the metal film 12 acts as feeder paths for applying an anode voltage to the respective anodes 15.

Figure 5:
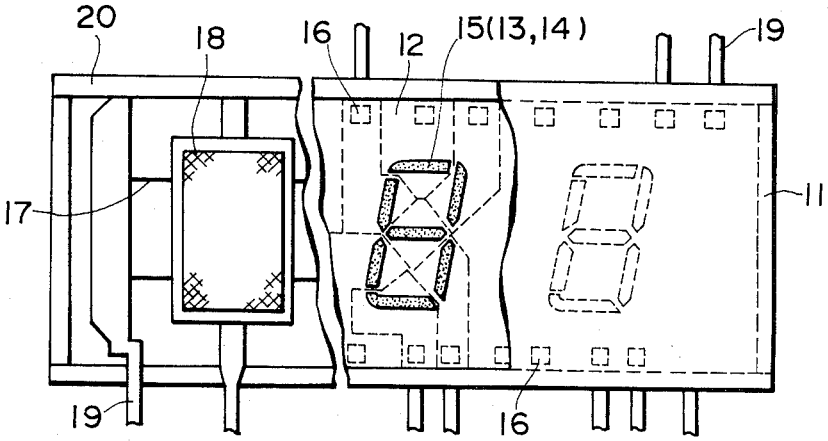
FIG. 5 is a partially broken plan view of the fluorescent display tube shown in FIG. 2.

A further construction of the fluorescent display tube of the embodiment having the anode substrate formed as mentioned above will now be explained with reference to FIGS. 2, 5 and 6.

The fluorescent display tube includes connecting sections 16 shown in broken lines in FIG. 2 which are formed at the periphery of the metal film 12 acting as wiring conductors. Above the display pattern sections, at least one filamentary cathode 17 is stretched along the direction in which the display pattern sections are arranged. If desired, a mesh-like control electrode 18 may be disposed between the anodes 15 and the cathode 17 which allows electrons emitted from the cathode to uniformly impinge on the anodes 15. These electrodes are received in an envelope formed by the substrate 11 and a casing 20 of a box-like shape hermetically sealed on the periphery of the substrate and highly evacuated. Reference numeral 19 designates external terminals for supplying driving signals to the respective electrodes which are hermetically passed through the periphery of the casing and connected to the respective connecting sections 16.

Figure 6:
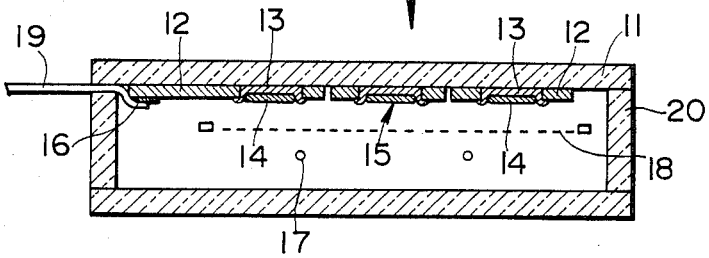
FIG. 6 is a vertical sectional view of the fluorescent display tube shown in FIG. 2.

When the fluorescent display tube having such construction as mentioned above is viewed from the direction indicated by an arrow in FIG. 6, non-light emitting anodes 15 and the portions of the metal film 12 forming a background of the anodes are observed to present white or translucent-white color; thus, the non-light emitting anodes are out of sight because they are buried in the background. Whereas, the anodes 15 to which an anode voltage is applied allow the fluorescent layer deposited thereon to emit light of its own luminous color. For example, when a ZnO system fluorescent layer is deposited on the anode, the anodes emit light of green or blue-green luminous color.

Thus, distinct luminous constrast can be obtained between the non-light emitting anodes and the light emitting anodes and between the light emitting anodes and the background of the non-light emitting anodes, resulting in luminous display being effected which can be easily observed even in a light environment.

A fluorescent display tube of the type that luminous display is observed through a substrate essentially has a wide visual angle and allows its internal structure to be hidden. The fluorescent display tube of the embodiment illustrated has, in addition to such advantages, a further advantage that it can provide luminous display with a much wider visual angle to allow it to be more easily observed, because luminescence of the fluorescent layer 14 is highly scattered in the direction in which luminous display is to be observed due to roughness formed on the surface of the substrate.

Also, in the embodiment, the contour of the display patterns is defined by the contour of the openings P formed by etching the metal film according to a photolithography procedure, because the metal film 12 also acts as a barrier to light. It is known that such etching treatment can be carried out with a high precision of the order of a few microns. Thus, the contour of the display patterns can be precisely formed to permit more easily observable and clean luminous display to be obtained.

The metal film 12 forming a background of the anodes 15 also acts as the wiring conductors as mentioned above. Therefore, when the anode conductors 13 of a transparent conductive material are formed according to a printing or mask vaporization procedure, it is possible to eliminate a process of forming an insulating layer. This allows the manufacturing process to be substantially simplified.

Further, the openings P of the display sections are surrounded at the periphery thereof by the metal film 12. Therefore, even if the fluorescent layer 14 is not deposited in position or the periphery of the fluorescent layer sags, such deviation or sagging of the fluorescent layer is allowed to appear on the metal film rather than the openings. Thus, such defects can be masked by the metal film to effectively prevent the quality of luminous display from being damaged.

In a fluorescent display tube of such type, there is a fear that the path along which electrons impinge on light emitting anodes is affected by an electric field generated by adjacent anodes having a non-luminous voltage applied thereto, to thereby cause any display defect to occur at the periphery of a fluorescent layer. However, the embodiment can effectively prevent such display defect from adversely affecting the quality of luminous display, because the defect is substantially masked by the metal film 12.

Furthermore, in the embodiment, a transparent conductive material forming the anode conductor 13 is deposited in thickness of the order of several thousand Å or less, resulting in the surface of the anode conductor having a roughness substantially corresponding to that of the substrate 11. Thus, the fluorescent material particles can enter into the roughness or recesses of the anode conductor to increase the contact area between the fluorescent material particles and the anode conductor 13, to thereby increase the bonding strength therebetween.

As explained hereinbefore, in the embodiment illustrated, the metal film 12 acting as a background of luminous display and a feeder path is provided with the openings P, in which the anode conductors 13 are depositedly formed. Thus, in the embodiment there is a fear that any display defect occurs when the anode conductors are disposed with respect to one another with narrow intervals, because the application of a cathode voltage or more negative voltage to the wiring conductors adjacent to the anode conductors generates a negative electric field to cause the passage of electrons to be disturbed, to thereby form the periphery of the anode 15 with an area on which electrons do not impinge.

Figure 7:
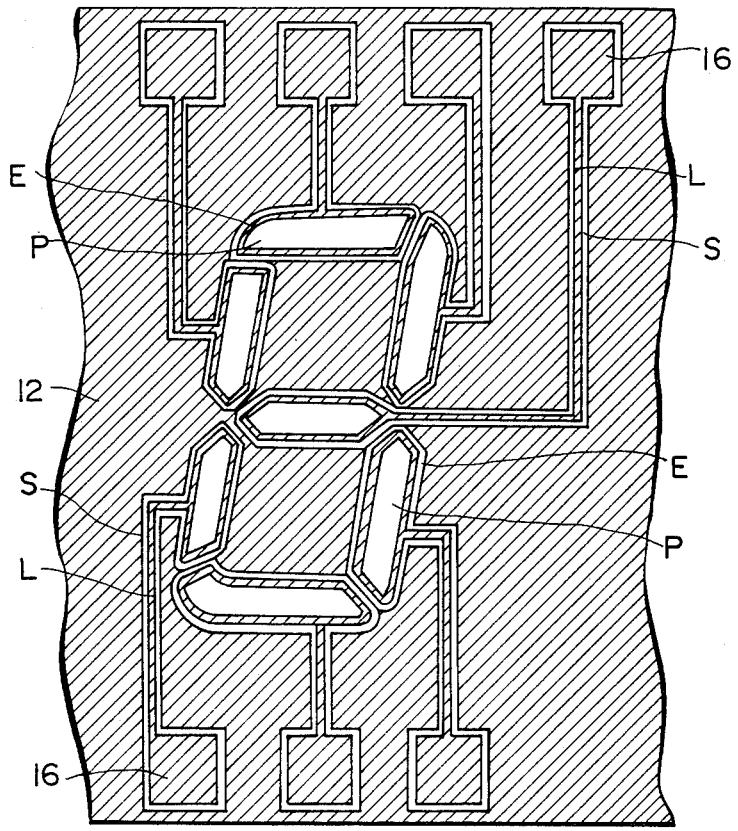
FIG. 7 is a plan view showing the essential portion of another embodiment of a fluorescent display tube according to the present invention.

FIG. 7 shows another embodiment of a fluorescent display device according to the present invention which is adapted to completely prevent the display defect as mentioned above by forming wiring conductors for anodes 15 separate from a metal film 12.

More particularly, in the fluorescent display device of FIG. 7, the metal film 12 deposited on one surface of a substrate formed of a light scattering material is subjected to an etching treatment to provide connecting elements 16 for external terminals, openings P each having a metal film E left at the periphery thereof and slits S each having a metal film or wiring conductor L left therein which acts to connect the metal film E with the corresponding connecting element 16. Thus, it will be noted that the metal film 12 is left at only areas shown in oblique lines. The portions of the metal film 12 except the metal films E, connecting elements 16 and wiring conductors L are applied thereto a potential constantly kept positive with respect to a cathode to form a positive electric field around each of the anodes 15, to thereby effectively prevent the display defect mentioned above.

Figure 8:
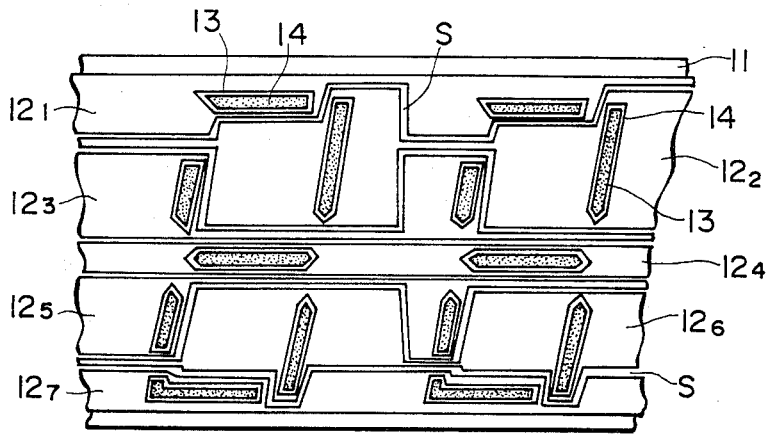
FIG. 8 is a plan view showing the essential portion of a further embodiment of a fluorescent display tube according to the present invention.

FIG. 8 illustrates a further embodiment of a fluorescent display tube according to the present invention, which has a metal film patterned to accomplish luminous display utilizing a dynamic driving system.

In the embodiment of FIG. 8, the metal film 12 is divided into a plurality of sections $12_1$, $12_2$, $12_3$ . . . $12_7$ which are electrically separated from one another by slits S so as to act as wiring conductors with respect to the corresponding anode conductors of the respective digits and as backgrounds of the anode conductors.

In the fluorescent display tube of the present invention explained hereinbefore, the display pattern is not limited to the form of the letter "8". It is a matter of course that the present invention is also applicable to an alpha-numeric display pattern for character display, a pattern formed by arranging dot-shaped anodes in a matrix shape, or the like.

In addition, it should be noted that the present invention can be also constructed to accomplish a fixed luminous display as obtained by a display device such as, for example, an alarm display device, a guide display device or the like as well as luminous display varied depending on combination of light emitting anodes.

As explained hereinbefore, the fluorescent display tube according to the present invention comprises the substrate having light permeable and light scattering properties such as ground glass or the like; the metal film deposited on one surface of the substrate which presents white, translucent-white or opaque yellow color due to the light scattering action of the substrate when it is observed from the other surface of the substrate; the anode conductors of a transparent conductive material deposited on the display pattern sections formed by removing a part of the metal film; and the fluorescent layer deposited on each of the anode conductors and its vicinity; whereby luminous display is observed through the anode conductors and substrate.

Thus, in the fluorescent display tube of the present invention, the non-light emitting anodes and the background thereof are observed to have the substantially same color. This results in only the light emitting anodes being clearly observed in distinction from the non-light emitting anodes and the background. This also allows the fluorescent display tube to provide luminous display with a wider visual angle and hide the internal structure from a visual field, as well as provide distinct luminous display easily observable and without any display defect. Also, since the substrate is formed of a light scattering material, it is possible to prevent a problem of halation often encountered in the use of a substrate formed of a transparent glass, to thereby effect luminous display of a high quality.

Furthermore, in the present invention, a part of the metal film may be used as the wiring conductor as well, therefore, it is not required to separately provide a wiring conductor. Thus, the present invention can substantially simplify the manufacturing process. Also, since the fluorescent layer is deposited on the rough surface of the substrate, the bounding strength of the fluorescent layer with respect to the substrate may be significantly increased, to thereby highly improve the structural strength and performance of the fluorescent display tube.

Obviously many modifications and variations of the present invention are possible in the light of the above teachings. It is therefore to be understood that within the scope of the appended claims the invention may be practiced otherwise than as specifically described.

What is claimed is:

1. A fluorescent display device, comprising:

a substrate made of a light permeable insulating material;

a non-transparent metal film depositedly formed on one surface of said substrate and divided into a plurality of sections electrically separated from one another by narrow slits, said sections of said metal film being formed with respective openings corresponding to the shape of a display pattern;

anode conductors formed of a substantially transparent conductive material, each of said anode conductors being depositedly formed in each of said openings so as to cover the portion of said substrate at which each said opening is provided and at least a part of said metal film provided at the periphery of each said opening;

a cathode disposed opposite and spaced apart from said anode conductors;

a fluorescent layer deposited on each of said anode conductors which emit light when electrons from said cathode impinge thereon;

whereby luminous display of said fluorescent layers is adapted to be observed from the other surface of said substrate.

2. A fluorescent display tube as defined in claim 1, wherein said light permeable insulating material is a light scattering glass.

3. A fluorescent display tube as defined in claim 1, wherein said metal film is an electrically conductive film deposited according to a physical procedure selected from the group consisting of vacuum deposition, sputtering and ion plating.

4. A fluorescent display tube as defined in claim 1, wherein said sections of said metal film respectively form feeder paths for said anode conductors.

5. A fluorescent display tube as defined in claim 2, wherein said light scattering glass is a frosted glass, said metal film being deposited on the rough surface of said frosted glass.

6. A fluorescent display tube as defined in claim 1, wherein said metal film is formed of aluminum.

7. A fluorescent display tube as defined in claim 1, wherein said metal film has an insulating layer deposited thereon which has a color similar to non-luminous color of said fluorescent layer.

8. A fluorescent display tube as defined in claim 1, wherein each of said fluorescent layers is deposited on said anode conductor so as to cover said opening and the periphery thereof.

* * * * *